United States Patent [19]

Sätterberg et al.

[11] 4,193,505

[45] Mar. 18, 1980

[54] ARRANGEMENT IN A HYDRAULICALLY OPERATED CRANE

[75] Inventors: Lars H. Sätterberg, Partille; Hans Eliasson, Vindeln, both of Sweden

[73] Assignee: Jonsereds AB, Partille, Sweden

[21] Appl. No.: 886,500

[22] Filed: Mar. 14, 1978

[30] Foreign Application Priority Data

Mar. 21, 1977 [SE] Sweden ..... 7703196

[51] Int. Cl.[2] ..... B66C 23/06

[52] U.S. Cl. ..... 212/55; 414/718

[58] Field of Search ..... 212/55; 214/141; 414/718

[56] References Cited

U.S. PATENT DOCUMENTS

| | | | |
|---|---|---|---|
| 2,959,923 | 11/1960 | Shook | 212/55 |
| 3,469,712 | 9/1969 | Haulotte | 212/55 |
| 3,752,327 | 8/1973 | Olson | 212/55 |
| 3,889,818 | 6/1975 | Wennerstrom | 212/55 |

*Primary Examiner*—Albert J. Makay
*Assistant Examiner*—Edmond G. Rishell, Jr.
*Attorney, Agent, or Firm*—Karl W. Flocks

[57] ABSTRACT

An arrangement in a hydraulically operated crane of the type having a supporting crane section and a movable crane arm system supported thereby and comprising support and guide means, telescopically extendable boom means including a first boom movably supported and guided by the support and guide means and a second boom supported by and telescopically movable in relation to the first boom; and drive means for moving the first boom in relation to the support and guide means and for moving the second boom in relation to the first boom; the drive means comprising an elongated flexible drive transmission means fixed to the support and guide means and extending into the first hollow boom through one end thereof and fixed to the second boom, the flexible transmission means being arranged such that a movement of the first boom in relation to the support and guide means will be transmitted by the flexible transmission means to the second boom for moving the latter in relation to the first boom a distance equal to the distance by which the first boom is moved in relation to the support and guide means.

2 Claims, 6 Drawing Figures

1
2
3
4
5
6
7
8
9
10
10
11
22
23
50
51
52
53
54
55
56
57
58

ARRANGEMENT IN A HYDRAULICALLY OPERATED CRANE

The present invention relates to a hose running and hydraulic coupling arrangement in hydraulically operated cranes, for example vehicle-borne cranes.

In long-reach cranes provided with extension booms which support, at their outer end, a hydraulically operated implement such as a grab or the like, serious problems arise with regard to hose running, that is to say the arrangement and location of the hydraulic hoses. In a crane with an extension boom and hydraulic hoses which extend from the fixed portion of the crane to the extension boom, are carried thereon and extend to the forward end of the boom, the hydraulic hoses must allow for the requisite telescoping movements of the extension boom. If the hoses extend from the fixed crane portion to the rear end of the boom and through the boom to the forward end thereof, the ratio of the extension distance of the telescopic boom to the loose hose (which results in depending hose bights at the rear end of the boom) is normally 1:2. This means that when the boom is extended 1 m, there will be 2 m of loose hose at the rear, and when the boom is fully extended, there will be a very large amount of hose hanging at the rear.

The present invention has for its object to reduce and, if possible, to fully eliminate the drawbacks outlined above.

According to the invention, the crane is provided with two extension booms of which one, the inner or second boom, is telescopically movable in the other, outer or first boom, which, in its turn, is movable in a supporting crane section which, for example, is a tilt arm, that is, an outer arm pivoted to the crane arm system.

In the arrangement according to the invention the hydraulic hoses extend from the supporting crane section (for example the tilt arm) via a guide on the outer or first boom into said boom at the rear end thereof and into the inner or second boom at the rear end thereof, passing through said inner boom on to the forward end thereof and the drive means for extending and retracting the two booms is disposed such that the inner boom, on shifting the outer boom in relation to the supporting crane section, is moved in relation to the outer boom a distance equal to the distance by which the outer boom is moved in relation to the supporting crane section.

By this arrangement, the formation of loose hose coils at the rear end of the outer boom is avoided on movement of the outer boom, since the inner boom is always moved in relation to the supporting crane section twice as great a distance as the outer boom in relation to the supporting crane section and, therefore, always keeps the hoses stretched.

Naturally, the device generally used for extending and retracting the outer boom with respect to the supporting crane section in hydraulic cranes is a hydraulic motor. In powerful cranes which are to be capable of lifting heavy loads, the availability of flow and pressure for operating the extension booms is often restricted. When the booms are to be extended, the general need is one of high speed and low pressure force, whereas when the booms are to be retracted, the need is of slower speed and relatively high pull.

In a crane arranged according to the invention, in which the movement of the outer or first boom is transmitted to the inner or second boom, use is preferably made of two hydraulic motors instead of one. By using two hydraulic motors and arranging them such that they can be coupled in parallel or in series, it is possible for the operator to select full power and half speed or full speed and half power.

Hence, the invention also comprises a hydraulic regulator of this type.

The nature of the present invention and its aspects will be more readily understood from the brief description of the accompanying drawings, and discussion relating thereto.

Figures 1, 6:
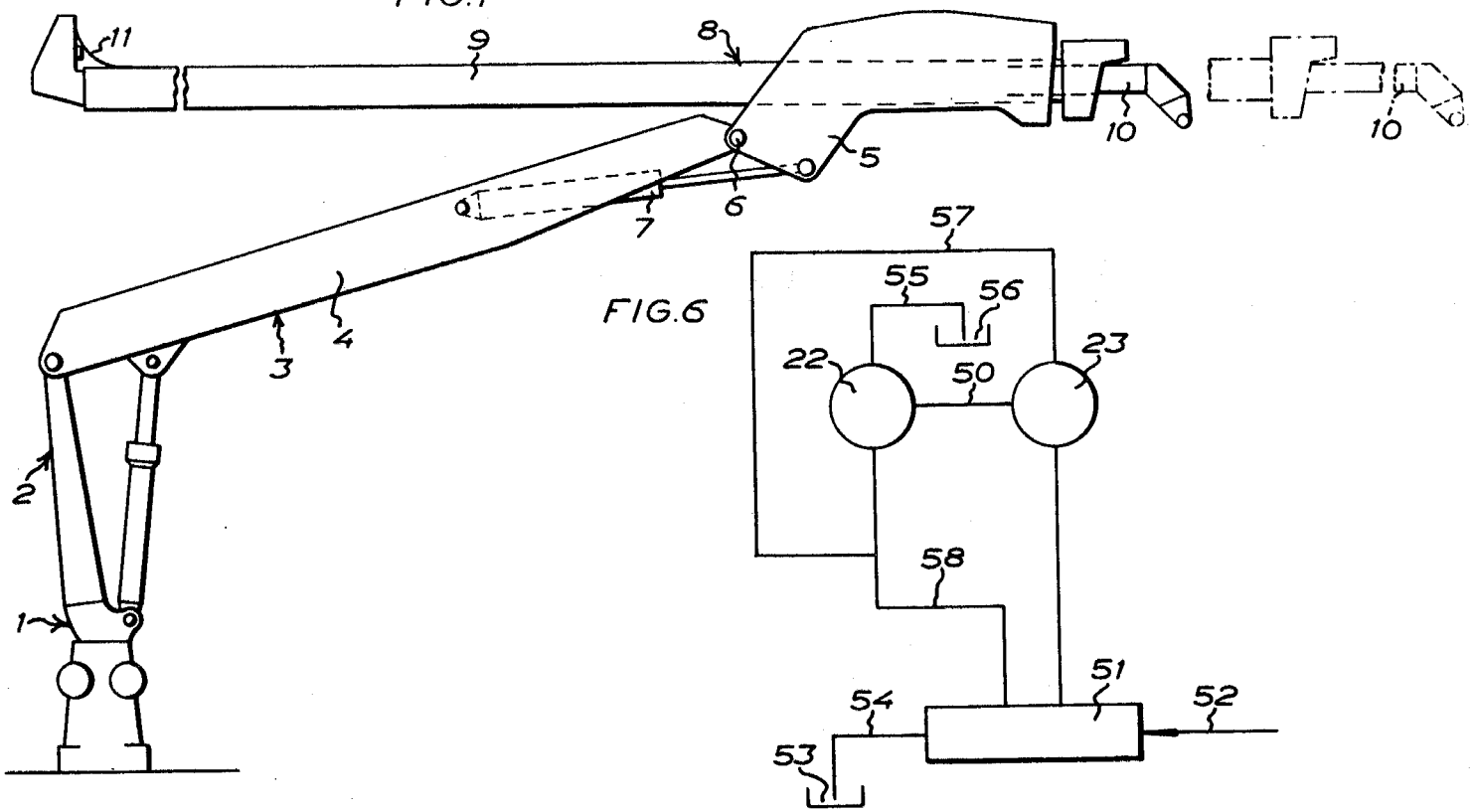
FIG. 1 illustrates schematically and by way of example, a crane to which the present invention is applicable.
FIG. 6 is a schematic view of a hydraulic drive motor device for operating the boom system.

The crane illustrated in FIG. 1 comprises a crane structure 1 with a post 2 on which is supported a two-section boom system generally designated 3. A supporting crane section in the form of a tilt arm 5 is mounted on the end of the first section 4 of the boom system 3, the tilt arm being hinged to the first section 4 at 6 and adapted for pivotal movement by means of a piston and cylinder assembly 7 which acts between the first section 4 and the tilt arm 5. The tilt arm 5 is hollow and forms a guide for a telescopic boom system which is generally designated 8 and comprises an outer box-beam type boom 9 movably guided in the tilt arm 5, and an inner boom 10, which is also hollow and may be of box-beam type and is movably guided in the outer boom 9.

The hydraulic lines or hoses 11 (please see also FIG. 2) extend from a hose fastening 12 from the tilt arm 5 rearwardly to the rear end of the outer boom 9, and into the rear end of the inner boom 10, passing through said inner boom on to the forward end thereof, where the hoses terminate at a hose fastening 15. The hoses may extend from the hose fastening 12 on the tilt arm 5 across a guide roller (not shown) mounted on the tilt arm and thence to a guide roller 13 shown in FIG. 2 which is mounted on the rear end of the outer boom 9. Guides (not shown) are provided for guiding the inner boom 10 in the outer boom 9. Guides are also provided, for example guide rollers 16–20, for guiding the outer boom 9 in the tilt arm 5.

For retraction and extension, the boom system is driven by drive means generally designated 21 and including one or preferably two hydraulic motors 22, 23 (please see FIG. 6) for driving a drive chain 24 by the intermediary of a sprocket 25. The drive chain 24 extends from an anchorage 26 at the forward end of the outer boom 9 and rearwardly to a sprocket connected to the guide roller 19, under this sprocket and to the drive sprocket 25, thence rearwardly under and in contact with a sprocket connected to the guide roller 18 and to a chain anchorage 26' on the rear end of the outer boom 9. Thus, when the chain 24 is driven, the outer boom 9 may be reciprocated in relation to the tilt arm 5. For shifting the inner boom 10, a wire rope 27 is connected at its one end to an anchorage 28 on the rear end of the inner boom 10 and extends over a pulley 29 which is connected to the hose guide roller 13, to an anchorage 30 on the tilt arm 5. Furthermore, a wire rope 31 extends from an anchorage 32 on the tilt arm 5 in a forward direction over a pulley 33 monted on the forward end of the outer boom 9, and rearwardly to an anchorage 34 on the inner boom 10.

The transmission is arranged such that, on extension of the outer boom 9, one wire rope 31, because of its connection to the anchorage 34 on the inner boom 10, extends this boom a distance in relation to the outer boom 9 which is equal to the distance by which the outer boom 9 is extended by means of the drive chain 24. The other wire rope 27 operates in the same manner on retraction of the outer boom 9, that is, it then simultaneously retracts the inner boom 10 in the outer boom 9 a distance equal to that by which the outer boom 9 is moved in relation to the tilt arm 5. As a result, the hydraulic hoses 11 will always be kept tight and thus, depending hose bights are eliminated which otherwise are common at the rear end of telescopic boom systems in cranes of the illustrated type.

Figure 2:
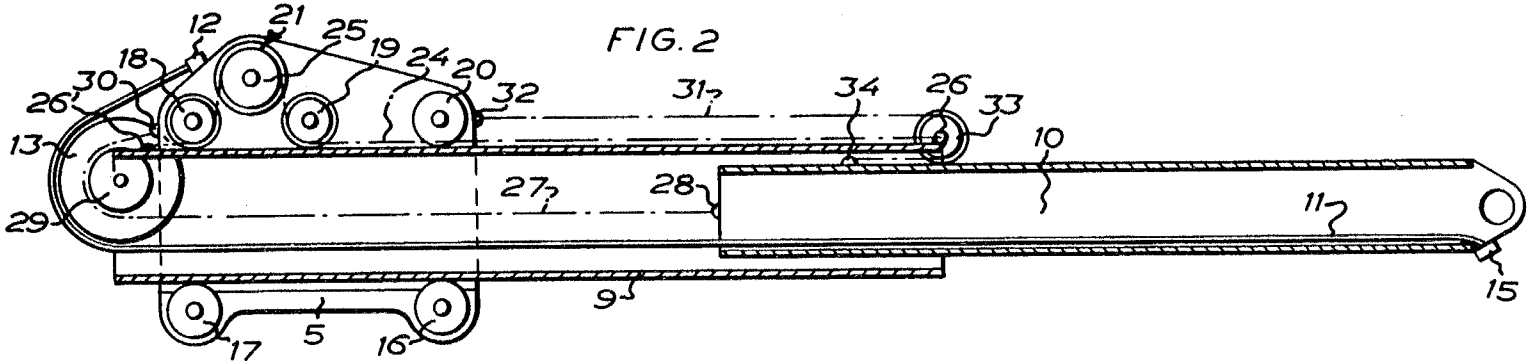
FIG. 2 is a schematic longitudinal sectional view of the tilt arm and extension booms, showing the drive means for the booms and the hose running.
Figure 3:
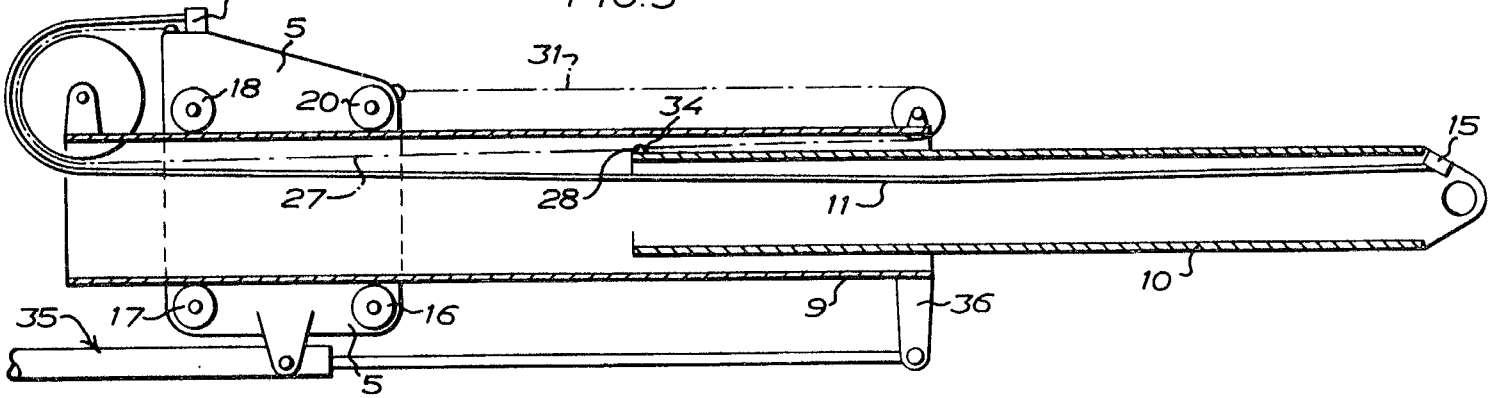
FIGS. 3, 4 and 5 show, in a manner similar to FIG. 2, three possible variations of the drive means.

The hydraulic motor used in the embodiment of FIG. 2, which is a rotary type hydraulic motor supported within the tilt arm 5, and the drive chain 24 may be replaced by a hydraulic cylinder, such as the hydraulic cylinder 35 shown in FIG. 3 which is supported by the tilt arm 5 and acts between the tilt arm 5 and the outer boom 9 via an anchorage 36. Otherwise, the device according to FIG. 3 is equivalent to the device in FIG. 2, and the same reference numerals have been used for equivalent parts.

Figure 4:
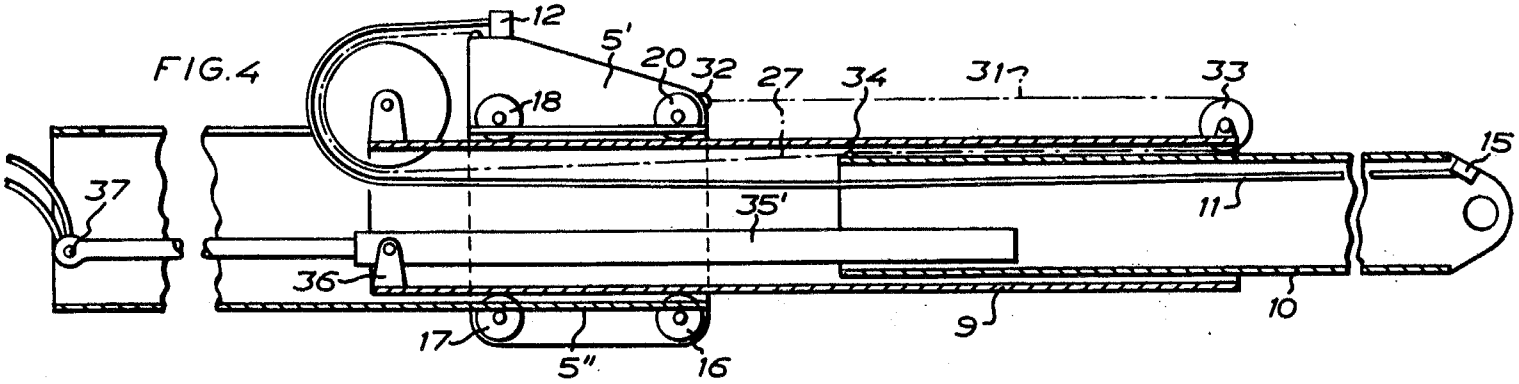

In the embodiment shown in FIG. 4, use is made, as the hydraulic motor, of a cylinder 35' which corresponds to the cylinder 35 in FIG. 3 but is housed within the outer boom 9 in such a position that the inner boom 10 is not hindered in its movements. The cylinder is connected to the tilt arm 5' (which is longer than the tilt arm 5 in FIGS. 1–3) with its piston rod attached to an anchorage 37, whereas the cylinder 35' proper is connected to the rear end of the outer boom 9 by the intermediary of an anchorage 36. In this embodiment, the two wire ropes 27, 31 are united at a single fastening point 34 on the inner boom 10.

Figure 5:
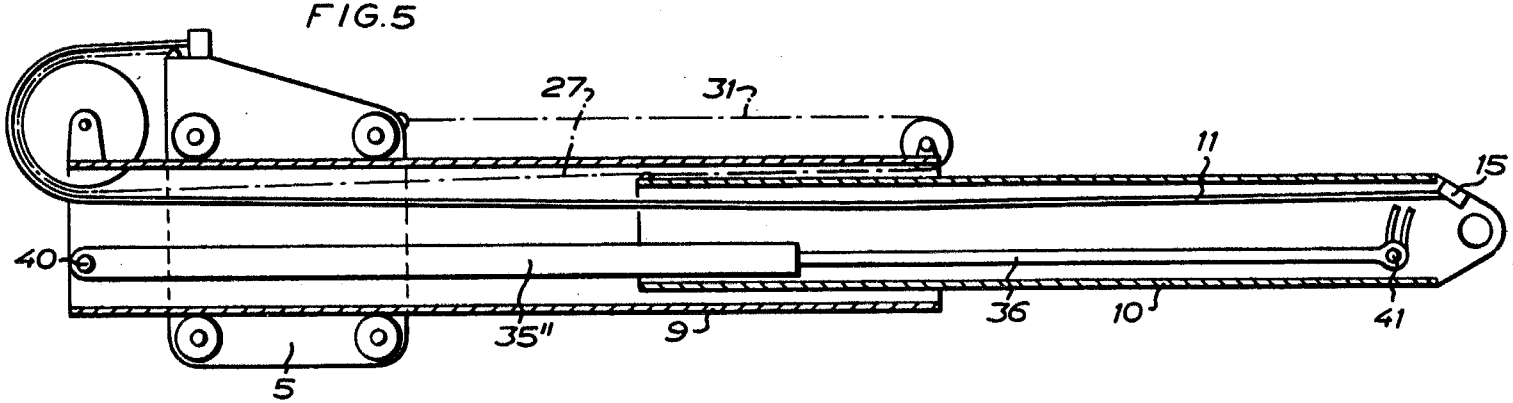

The embodiment in FIG. 5 differs from that of FIG. 4 in that the cylinder 35" is connected, at its rear cylinder end, to an anchorage 40 on the rear end of the outer boom 9, the end of its piston rod being connected to an anchorage 41 at the forward end of the inner boom 10. The wire ropes 27 and 31 are disposed in the same manner as in FIG. 5 and the tilt arm 5 is here shown as a tilt arm of a type similar to that in FIG. 2.

In all of the embodiments described above, the problem associated with loose hose bights has been eliminated by combining the hose running with the guiding of the movements of the two booms of the boom system in relation to each other and in relation to the supporting crane section, here shown in the form of a tilt arm 5.

In a hydraulic regulating system of the type shown in FIG. 6 use is preferably made of two hydraulic motors 22, 23 as drive means for extending and retracting the outer boom 9 in relation to the supporting crane section 5.

The rotary member of the two hydraulic motors are connected as intimated at 50. They are both connected to a common operating valve 51 which, in turn, is connected to a pump by means of a line 52 and to an outlet 53 by means of a line 54. One hydraulic motor 22 is directly connected via a line 55 to an outlet 56 (which may be the same as the outlet 53) while the other hydraulic motor 23 is provided with a shunt conduit 57 which extends to the line 58 between the hydraulic motor 22 and the operating valve 51.

This arrangement allows for series coupling of the two hydraulic motors 22, 23, in which case one hydraulic motor can be considered as idling since it follows the other, and, besides, for parallel coupling of the two hydraulic motors. By this arrangement the two hydraulic motors can be coupled in parallel for full power and half speed or in series for full speed and half power. The arrangement can be likened to a device (gear) adjustable between two transmission ratios, or to a device which permits changing the displayed volume; i.e. in parallel-coupling the displaced volume and the power are twice as great as in series-coupling.

The invention is not restricted to the embodiments shown on the drawings and described above, many modifications being possible within the spirit and scope of the appended claims.

What we claim and desire to secure by Letters Patent is:

1. A hydraulically operated crane comprising a supporting crane section, an outer boom displaceably supported and guided in said supporting crane section, an inner boom displaceably supported and guided in said outer boom, hydraulic drive means disposed at the outer side of said supporting crane section and including at least one hydraulic motor, transmission means for moving said booms with respect to each other and to said supporting crane section, a guide member on the other boom, and at least one flexible hose or line extending from said supporting crane section over said guide member on the outer boom into said outer boom at the rear end thereof and into the inner boom at the rear end of the inner boom and on to the front end of the inner boom, said hydraulic drive means for moving said two booms in operation effecting displacement of said inner boom by a distance equal with respect to displacement of the outer boom as this latter boom is moved with respect to said supporting crane section, wherein the outer boom movable in said supporting crane section is extensibly positioned in opposite directions to either side of the supporting crane section by means of said hydraulic drive means and a part of said transmission means which acts between said hydraulic drive means and said outer boom.

2. Crane as claimed in claim 1, wherein the hydraulic drive means comprises two hydraulic motors connected to a hydraulic regulator circuit which permits hydraulic switching for series and parallel connection of said hydraulic motors to the power source.

* * * * *